US010875080B2

(12) United States Patent
Ohtoyo et al.

(10) Patent No.: US 10,875,080 B2
(45) Date of Patent: Dec. 29, 2020

(54) METHOD OF PRODUCING FORGED PRODUCT

(71) Applicant: HITACHI METALS, LTD., Tokyo (JP)

(72) Inventors: Daigo Ohtoyo, Tokyo (JP); Hideki Matsumoto, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 309 days.

(21) Appl. No.: 15/937,838

(22) Filed: Mar. 27, 2018

(65) Prior Publication Data

US 2018/0281049 A1 Oct. 4, 2018

(30) Foreign Application Priority Data

Mar. 28, 2017 (JP) ..... 2017-062801

(51) Int. Cl.
*B21J 5/02* (2006.01)
*B21J 1/06* (2006.01)
*B21J 3/00* (2006.01)

(52) U.S. Cl.
CPC ..... *B21J 5/025* (2013.01); *B21J 1/06* (2013.01); *B21J 3/00* (2013.01)

(58) Field of Classification Search
CPC ..... B21J 3/00; B21J 5/02; B21J 5/025; B21J 1/06; B21C 23/32; B21D 37/18; B21K 1/32; B21K 1/36
See application file for complete search history.

(56) References Cited

U.S. PATENT DOCUMENTS 4,055,975 A * 11/1977 Serfozo ..... B21J 5/02 72/42
6,330,818 B1 12/2001 Jain
2011/0302979 A1* 12/2011 Oppenheimer ..... C10M 103/02 72/42
2017/0283926 A1* 10/2017 Aoki ..... B21J 3/00
2020/0094309 A1* 3/2020 Suzuki ..... B21J 13/02

FOREIGN PATENT DOCUMENTS

JP H02104435 4/1990
JP 2016215275 12/2016
WO 2016052523 4/2016
WO 2018117226 6/2018

OTHER PUBLICATIONS

"Search Report of Europe Counterpart Application", dated Aug. 17, 2018, p. 1-p. 9.

* cited by examiner

*Primary Examiner* — Debra M Sullivan
(74) *Attorney, Agent, or Firm* — JCIPRNET

(57) ABSTRACT

A method of producing a forged product is described, in which a forging component is hot-forged using a lower die and an upper die. The method includes a first process in which at least a part of an die face of the lower die is covered with a first glass lubricant; a second process in which the lower die is heated; a third process in which at least a part of the forging component is covered with a second glass lubricant; a fourth process in which the forging component is heated to a temperature that is higher than a heating temperature of the lower die in the second process; and a fifth process in which the forging component is placed on the die face of the lower die and hot forging is performed using the lower die and the upper die.

12 Claims, 3 Drawing Sheets

METHOD OF PRODUCING FORGED PRODUCT

CROSS-REFERENCE TO RELATED APPLICATIONS

This application claims the priority benefit of Japanese application serial no. 2017-062801, filed on Mar. 28, 2017. The entirety of the above-mentioned patent application is hereby incorporated by reference herein and made a part of this specification.

BACKGROUND

Technical Field

The disclosure relates to a method of producing a forged product such as a turbine disk for an aircraft jet engine.

Description of Related Art

In recent years, there has been increasing demand for large thermally closed die forging products constituting a jet engine for medium and large aircrafts and steam turbines for power plants. For example, a turbine disk of an aircraft jet engine may be made of a nickel-based heat-resistant superalloy or a titanium alloy and be formed in a rotating body with a size greater than 1 meter in diameter. In order to produce such a large forged product, a very large pressure force of greater than 150 MN is necessary during hot closed die forging. Thus, a large hot forging machine is necessary and a large hot forging machine of a class of 500 MN is used.

Incidentally, the above nickel-based heat-resistant superalloys and titanium alloys are known as hard-to-process materials for which hot forging is difficult, and a forging load is significantly high during hot forging. Thus, there have been attempts to reduce friction during hot forging using a lubricant and reduce a forging load. For example, Japanese Unexamined Patent Application Publication No. H 2-104435 (Patent Document 1) discloses an invention of a lubrication method for hot forming of a titanium alloy in which, when a titanium alloy material is pressure-forming using a heated die, the surface of the material is coated with glass-based and boron nitride-based lubricants in advance in a double coating manner and then pressure-forming is performed.

[Patent Document 1] Japanese Unexamined Patent Application Publication No. H2-104435

However, when a large forging component is hot-forged using a large hot forging machine of a class of several hundreds of MN, lubrication is insufficient with only the configuration disclosed in Patent Document 1 and there is a problem of a load at the last stage of hot forging becoming excessively large. In view of such a problem, the disclosure provides a method of producing a forged product through which it is possible to prevent a load from excessively increasing during forging even if a large forging component is hot-forged.

SUMMARY

The inventors found that the increase in the load described above is caused by lack of lubrication during forging, conducted extensive studies regarding a method of preventing such lack of lubrication, and completed the disclosure.

That is, according to an embodiment of the disclosure, there is provided a method of producing a forged product in which a forging component is hot-forged using a lower die and an upper die, the method including a first process in which at least a part of an die face of the lower die is covered with a first glass lubricant; a second process in which the lower die subjected to the first process is heated; a third process in which at least a part of the forging component is covered with a second glass lubricant; a fourth process in which the forging component subjected to the third process is heated to a temperature that is higher than a heating temperature of the lower die in the second process; and a fifth process in which the forging component subjected to the fourth process is placed on the die face of the lower die subjected to the second process and hot forging is performed using the lower die and the upper die, wherein materials of the first glass lubricant and the second glass lubricant are different from each other, wherein the second glass lubricant remains on the surface of the forging component that is softened in the fourth process, and wherein hot forging in the fifth process starts while the first glass lubricant and the second glass lubricant are softened.

According to another embodiment of the disclosure, there is provided a method of producing a forged product in which a forging component is hot-forged using a lower die which has an die face and an upper die, the method including: a first process in which at least a part of an die face of the lower die is covered with a first glass lubricant; a second process in which the lower die subjected to the first process is heated; a third process in which at least a part of the forging component is covered with a second glass lubricant; a fourth process in which the forging component subjected to the third process is heated to a temperature that is higher than a heating temperature of the lower die in the second process; and a fifth process in which the forging component subjected to the fourth process is placed on the die face of the lower die subjected to the second process and hot forging is performed using the lower die and the upper die, wherein materials of the first glass lubricant and the second glass lubricant are different from each other, wherein a viscosity of the first glass lubricant at a temperature corresponding to a temperature of the die face of the lower die when hot forging starts in the fifth process is $1\times10^7$ Pa·s or less, and wherein a viscosity of the second glass lubricant at a temperature corresponding to a heating temperature of the forging component in the fourth process is $1\times10^2$ Pa·s or more and a viscosity of the second glass lubricant at a temperature corresponding to a surface temperature of the forging component when hot forging starts in the fifth process is $1\times10^7$ Pa·s or less.

In addition, in the methods of producing a forged product, preferably, the lower die and the upper die each have a Ni-based heat-resistant superalloy layer as a cladding layer on the die face. In addition, preferably, the second process includes a die heating process in which a preheated dummy component is interposed between the lower die and the upper die. In addition, preferably, the die face of the lower die is partially covered with the first glass lubricant, and, in the fifth process, an end of the forging component slides on the die face of the lower die in an area in which the first glass lubricant has been applied. In addition, preferably, the forging component is preferably formed in a rotating body. In addition, preferably, in the fifth process, an end of the forging component is displaced by 200 mm or more on the die face of the lower die.

DESCRIPTION OF THE EMBODIMENTS

Figure 1:
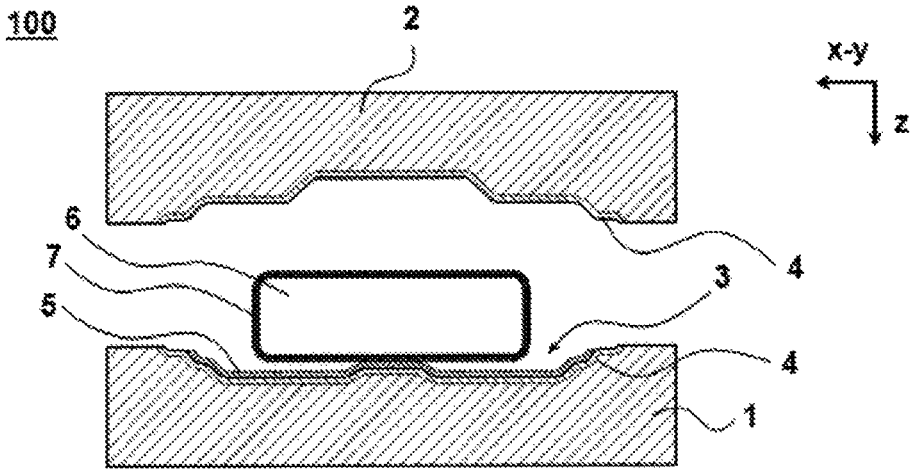
FIG. 1 is a schematic diagram showing an example of a die used in an embodiment according to the disclosure.

According to the hot forging method of the disclosure, even if a large forging component is hot-forged, it is possible to prevent lack of lubrication and reduce a forging load.

The disclosure relates to a method of producing a forged product. The method includes a first process in which at least a part of an die face of a lower die is covered with a first glass lubricant, a second process in which the lower die subjected to the first process is heated, a third process in which at least a part of a forging component is covered with a second glass lubricant, a fourth process in which the forging component subjected to the third process is heated to a temperature higher than a heating temperature of the lower die in the second process, and a fifth process in which the forging component subjected to the fourth process is placed on the die face of the lower die subjected to the second process and the lower die and an upper die are hot-forged. That is, the disclosure relates to a so-called hot closed die forging in which a forging component is hot-forged using a lower die and upper die which have die face impression.

One of important features of the disclosure is that materials of the first glass lubricant and the second glass lubricant are different from each other. Moreover, in connection with such a feature, the disclosure has the following first embodiment and second embodiment. The first embodiment is that the second glass lubricant remains the surface of the forging component that is softened in the fourth process and hot forging in the fifth process starts while the first glass lubricant and the second glass lubricant are softened. In addition, the second embodiment is that the first glass lubricant has a viscosity of $1\times10^7$ Pa·s or less at a temperature corresponding to a temperature of the die face of the lower die when hot forging in the fifth process starts, and the second glass lubricant has a viscosity of $1\times10^2$ Pa·s or more at a temperature corresponding to a heating temperature of the forging component in the fourth process and a viscosity of $1\times10^7$ Pa·s or less at a temperature corresponding to a surface temperature of the forging component when hot forging in the fifth process starts. According to such features, since the effect of the lubricant is maintained to the last stage of forging, it is possible to prevent lack of lubrication during hot forging and reduce a forging load.

Embodiments of a method of producing a forged product according to the disclosure will be described below in detail with reference to the drawings. However, the disclosure is not limited thereto. In addition, components described in the present embodiment can be combined with each other as long as functions thereof are not impaired.

Hot forging in the present embodiment includes hot pressing, constant temperature forging, hot die forging, and the like. In hot forging, hot forging using a large hot pressing machine is particularly appropriately applied. For example, in large hot pressing of 400 MN or more, when a large product with a diameter of greater than 1 m is forged, since there is no margin for a load capacity, the disclosure through which it is possible to reduce a forging load is particularly effective. A forged product refers to a product that is produced through forging such as a turbine disk and a turbine blade, and the forging component is a preformed substance for obtaining a final form of the forged product. In the forging component, intermediate materials in the intermediate stage in which hot forging is performed several times (several blowing operations) are also included in addition to a billet. As the material of the forging component, for example, a Ni-based heat-resistant superalloy, a Ti alloy, or the like can be used.

FIG. 1 shows an example of a die used in the method of producing a forged product of the present embodiment. Here, a die for a disk-shaped forged product in which lack of lubrication easily occurs over a large area will be exemplified. When the forging component is formed in a rotating body as in a disk-shaped forged product, the forging component needs to be uniformly deformed in all directions, and a deformation range is also wide. Accordingly, lack of lubrication easily occurs as described above. The disclosure through which it is possible to prevent lack of lubrication is particularly effective. A die 100 includes a lower die 1 and an upper die 2 disposed to face the lower die 1. A vertical direction (z direction) in FIG. 1 is a direction in which pressing is performed.

Here, in FIG. 1, die plates for fixing the lower die 1 and the upper die 2, and a main body of a press machine are not shown. The lower die 1 and the upper die 2 each have an die face 3 on which a predetermined irregularity or the like is formed according to a shape of the product. A cavity is formed between the die face of the lower die 1 and the die face of the upper die 2 according to the shape of the product. The die face 3 is a surface that is designed and processed to include a machining area for the final form of the product after hot forging.

A base material of the die 100 is not particularly limited, but in consideration of strength and cost, hot die steels such as SKD61 and SKT4 specified in JIS G4404 and improved steels thereof can be used. In addition, preferably, the lower die 1 and the upper die 2 each include a Ni-based heat-resistant superalloy layer as a cladding layer 4 on the die face 3. Such a configuration is preferable when a hard-to-process material such as a Ni-based heat-resistant superalloy or a Ti alloy is hot-forged. The reason for this is as follows. When the hard-to-process material is hot-forged, a forging temperature is, for example, 1000° C. or higher, and a surface (working part) of the die is exposed to a high temperature. On the other hand, when a forging temperature exceeds a tempering temperature of the hot die steel, the hot die steel is softened. On the other hand, when a cladding layer of a Ni-based heat-resistant superalloy that has an excellent strength at a high temperature is formed on the die face that is a working part, the cladding layer functions as a softening prevention layer for the base material of the die. In addition, since thermal conductivity is low, the cladding layer has an effect of retaining heat of a preheated die. In addition, as another effect, it is found that, when a temperature of the die increases, a chemical reaction between a self-oxidizing film with elements contained in the Ni-based heat-resistant superalloy and elements contained in the first glass lubricant occurs at a bonding interface between the Ni-based heat-resistant superalloy layer and the first glass lubricant, the component of the first glass lubricant is slightly modified and there is an effect of increasing a viscosity of the first glass lubricant. Accordingly, when the temperature of the die before hot forging increases, it is possible to prevent a viscosity of the first glass lubricant from excessively decreasing.

In addition, the cladding layer improves oxidation resistance of a work surface and contributes to obtaining a high strength. Here, the Ni-based heat-resistant superalloy is an alloy which contains a largest amount of Ni by mass % and in which the alloy is able to be strengthening (hardening) due to precipitation of intermetallic compounds in a γ' phase or the like. For example, Udimet 520 equivalent alloys (UDIMET is a registered trademark of Special Metals, Udimet 720 equivalent alloys, Waspaloy equivalent alloys (Waspaloy is a registered trademark of United Technologies), and Alloy 718 equivalent alloys can be used. The cladding layer can be formed of, for example, an alloy in the form of a wire, powder, or the like, by welding.

In the embodiment shown in FIG. 1, the lower die 1 and the upper die 2 each have the cladding layer 4 on the entire die face 3. Alternatively, a configuration in which a cladding layer is provided on a part of the die face can be used. For example, when a cladding layer is formed on only a part whose temperature is likely to increase, it is possible to reduce costs.

Processes of the method of producing a forged product performed using the above forging component and die will be described below.

<First Process>

Figure 2A:
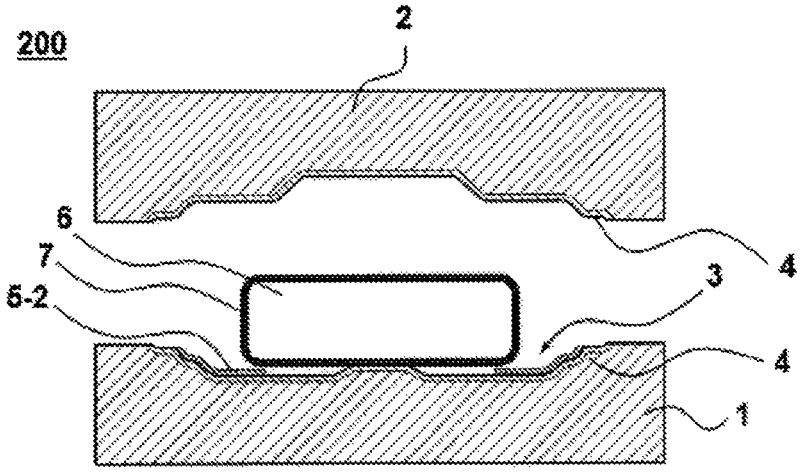
FIG. 2A and FIG. 2B are schematic diagrams showing another example of the die used in the embodiment according to the disclosure.
Figure 2B:
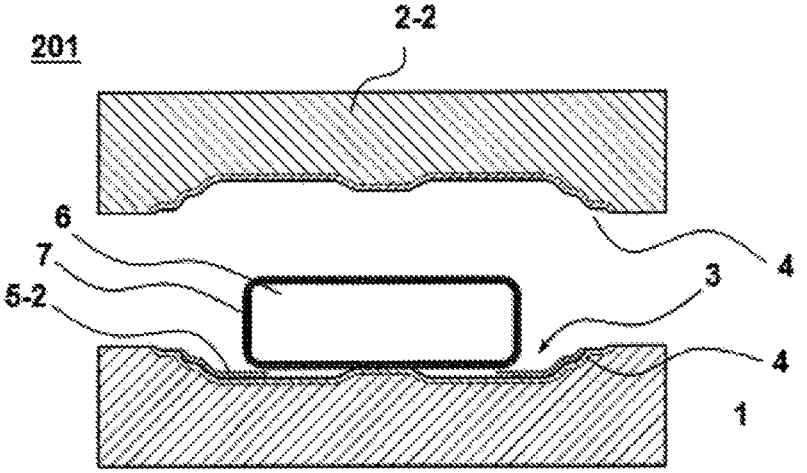

In the first process, at least a part of the die face 3 of the lower die 1 is covered with a first glass lubricant 5. When the entire die face 3 of the lower die is covered with the first glass lubricant 5 as shown in FIG. 1, the lubricity becomes more reliable. However, as shown in FIG. 2A and FIG. 2B, when a first glass lubricant 5-2 is partially applied to a part in which lack of lubrication easily occurs or the like, a sufficient effect can be obtained. FIG. 2A shows an example in which the die face 3 of the lower die 1 is partially covered with the first glass lubricant 5-2 in a die 200 having die faces that are vertically asymmetric as in FIG. 1. FIG. 2B shows an example in which the die face 3 of the lower die 1 is partially covered with the first glass lubricant 5-2 in a die 201 having die faces that are vertically symmetric. The lubricant need not be applied to the entire die face. When the first glass lubricant 5 is used in a part of the die face 3, it contributes to reducing an amount of lubricant used and shortening the coating process. For example, when a disk-shaped forging component 6 is hot-forged, an annular area excluding the center part of the die face corresponding to the center of the disk can be covered with the first glass lubricant. Specifically, at least, an area including a range in which an end of the forging component slides in the fifth process to be described below is preferably covered with the first glass lubricant. Here, when the cladding layer 4 is provided on the die face 3 of the lower die, the glass lubricant covers the die face 3 from above the cladding layer 4.

Since a required effect of reducing a forging load is obtained by covering the die face of the lower die, it is sufficient to cover the die face of the lower die in consideration of simplifying the process. However, it is also possible to cover the die face of the upper die with the first glass lubricant. Here, as described above, in order to modify the component of the first glass lubricant due to a chemical reaction resulting from heat at a bonding interface between the first glass lubricant and the lower die, a metal component constituting the lower die is preferably exposed. Thus, in a part to be covered with the first glass lubricant, preferably, the surface of the metal component is exposed reliably by, for example, sandblasting or grinding.

A method of applying the first glass lubricant is not particularly limited. For example, a slurry mixture or a suspension mixture containing a glass composition and a medium such as water can be provided on the die face as a coating by a method such as application or spraying. Application is preferable in consideration of simplifying the work and facilities, and spraying is preferable in consideration of uniformity of the thickness of the coating. After the application or the like, unnecessary medium is removed by drying, and the die face is covered with the first glass lubricant. While the first glass lubricant can be applied to the lower die at room temperature, preferably, the lower die is preheated to 50 to 200° C. and the preheated lower die is covered with the glass lubricant. This is because, when the lower die is preheated to 50° C. or higher, the medium can immediately evaporate and be removed after the application. On the other hand, when the lower die is preheated to a temperature of higher than 200° C., the medium evaporates immediately after the application, the glass lubricant is solidified, and it is particularly difficult to perform application with a uniform film thickness. In addition, this is because, when application is performed manually, it is difficult to perform working due to heat from the die. More preferably, a lower limit of the preheating temperature of the lower die is 80° C. In addition, more preferably, an upper limit of the preheating temperature of the lower die is 120° C.

The thickness of the coating of the first glass lubricant applied to the die face is not particularly limited as long as a lubricating ability is exhibited. However, the thickness is preferably 30 μm or more in order to prevent an increase in the forging load more reliably. In this case, it is preferable to ensure a coating thickness of 30 μm or more at a part in which lack of lubrication easily occurs (for example, an end of the die face) during hot forging. In addition, it is preferable to ensure a coating thickness of 30 μm or more on average on the entire die face, and a coating thickness of 30 μm or more on the entire die face is more preferable. When a coating thickness of the entire die face is measured, the thicknesses at a plurality of points including measurement points on at least the center and ends of the die face, and a midpoint thereof are evaluated. On the other hand, if the first glass lubricant is excessively thickened, since a significant improvement in the lubricating ability cannot be expected, the thickness is preferably 300 μm or less in consideration of cost reduction. Here, the thickness of the first glass lubricant can be measured by an eddy current film thickness meter.

<Second Process>

In the second process, the lower die 1 in which at least a part of the die face is covered with the first glass lubricant 5 in the first process is heated. In the second process, preferably, the upper die 2 (or upper die 2-2 in FIG. 2B) is heated together with the lower die 1. The first glass lubricant 5 is softened by selecting the heating temperature of the lower die 1, a material of the first glass lubricant 5, and the like, and a viscosity at a temperature corresponding to a temperature of the die face of the lower die when hot forging starts in the fifth process is set to $1\times10^7$ Pa·s or less. In order to prevent the temperature of the forging component during hot forging from decreasing, preferably, the die is preheated to 250° C. or higher using a heating furnace or the like and a temperature range that is less than the tempering temperature of the hot die steel, and then is subjected to forging. For example, in the case of hot die steels such as SKD61 and SKT4, a heating temperature is representatively 350° C. to 550° C. Here, when the lower die is heated, even in a structure in which a hot die steel is used as the base material and the Ni-based heat-resistant superalloy is clad on the die face, heating is preferably performed in a temperature range that is less than the tempering temperature of the hot die steel of the base material. In addition, when the Ni-based heat-resistant superalloy is clad on the die face, in order to cause a chemical reaction with the first glass lubricant according to formation of a self-oxidizing film of the Ni-based heat-resistant superalloy, it is preferable to ensure that there is sufficient oxygen in the heating furnace and it is preferable to heat the die face of the lower die that is at least exposed to the atmosphere.

The die 100 (the lower die 1 and the upper die 2) is heated using, for example, a preheating furnace, and the entire die is heated to a predetermined heating temperature (hereinafter simply referred to as $T_{wh}$). The lower die 100 taken out from the preheating furnace is fixed to a press machine through a die plate (this will also be referred to as a die attaching process. A surface temperature of the die fixed to the press machine gradually decreases.

A preferable range of $T_{wh}$ is 500° C. or higher and 550° C. or lower. A lower limit of $T_{wh}$ is more preferably 530° C. or higher. When the hot die steel is simply heated and $T_{wh}$ increases, there is limitation due to softening as described above. On the other hand, when the above cladding layer is provided, the following die heating process can be performed. The die heating process is a process in which, in order to maintain a high surface temperature of the die, a preheated dummy component is interposed between the lower die 1 and the upper die 2. Preferably, the surface temperature of the die face 3 is as high as possible in a range in which the strength of the hot die steel does not deteriorate. For example, when the dummy component heated to 900° C. or higher is used, the surface of the die face can be heated to a temperature of 500° C. or higher. When the cladding layer is provided, the surface temperature of the die face can be set to a temperature of higher than $T_{wh}$, for example, 580° C. or higher, or 600° C. or higher. Heating using the dummy component increases only the temperature of the cladding layer or the vicinity thereof, and temperature increase in the base material of the die can be avoided. Therefore, it is possible to increase the temperature of the die face to a temperature higher than the heating temperature of the die using the heating furnace.

While a dummy component with a simple shape such as a disk shape can be used, in order to heat the surface of the die uniformly and efficiently, a dummy component having a shape conforming to the shape of the die face is preferably used. The dummy component can be obtained by forming a die material in advance using the die used in hot forging. Here, when a heating process using the dummy component is included, the die attaching process is performed during the second process.

Since the die is taken out from the preheating furnace, heated using the dummy component, and is subjected to placement therein of a forging component to be described below, the temperature (hereinafter simply referred to as $T_{ss}$) of the die face of the lower die when hot forging starts (when pressing starts) changes from the heating temperature $T_{wh}$. Thus, a viscosity of the above first glass lubricant is based on the temperature $T_{ss}$ of the die face of the lower die when hot forging starts (when pressing starts). While the heating temperature $T_{wh}$ of the hot die steel such as SKD61 is about 550° C. as described above, the heating temperature of the forging component subjected to hot forging is a high temperature that is higher than a general $T_{wh}$ by 200° C. or higher as will be described below. Thus, when the heated forging component is placed on the die face of the lower die, the temperature of the die face at a part in which the forging component is placed rises by, for example, 30° C. or higher from $T_{wh}$. If it is difficult to measure the temperature $T_{ss}$ of the die face of the lower die at a part in which the forging component is placed when hot forging starts, a temperature of the heating temperature $T_{wh}$+30° C. is regarded as $T_{ss}$, and the first glass lubricant may be selected as follows.

In the second process, the glass lubricant having a viscosity of $1\times10^7$ Pa·s or less at a temperature corresponding to the temperature $T_{ss}$ may be selected as the first glass lubricant. When it is described that a viscosity at a temperature "corresponding to" the temperature $T_{ss}$ is used, this means that, since it is difficult to actually measure a viscosity at the temperature ($T_{ss}$) of the die face of the lower die when hot forging starts, the temperature $T_{ss}$ is evaluated or estimated in advance, and a viscosity at the same temperature as the temperature $T_{ss}$ is evaluated offline. The viscosity is set to $1\times10^7$ Pa·s or less in order to start hot forging in the fifth process to be described below while the first glass lubricant is softened. The above viscosity is more preferably $1\times10^5$ Pa·s or less, and most preferably $1\times10^3$ Pa·s or less. A lower limit of the above viscosity is not particularly limited as long as it functions as a lubricant. However, depending on the shape of the die face, when the viscosity is too low, since there is a possibility of the glass lubricant flowing away, 10 Pa·s or more is more preferable.

<Third Process>

In the third process, at least a part of a forging component 6 is covered with a second glass lubricant 7. Partial covering can be performed on a part in which lack of lubrication easily occurs or the like. However, when the entire forging component 6 is covered with the second glass lubricant 7, lubricity becomes more reliable. In addition, since the glass lubricant has a thermal insulation effect, it is possible to prevent a decrease in temperature when the forging component is taken out from the heating furnace and is placed on the die until forging starts. Therefore, it is preferable to cover the entire forging component.

A method of applying the second glass lubricant is not particularly limited. For example, a slurry mixture containing a glass composition and a medium can be provided on the surface of the forging component as a coating by a method such as application, spraying, or immersion. Application is preferable in consideration of simplifying the work and facilities, and spraying is preferable in consideration of uniformity of the thickness of the coating. After the application or the like, unnecessary medium is removed by drying, and the surface of the forging component is covered with the second glass lubricant. While the second glass lubricant can be applied to the forging component at room temperature, preferably, the forging component is preheated to 50 to 200° C., and the preheated forging component is covered with the glass lubricant. This is because, when the forging component is preheated to 50° C. or higher, the medium can immediately evaporate and be removed after the application. On the other hand, when the temperature exceeds 200° C., the medium evaporates immediately after the application, the glass lubricant is solidified, and it is particularly difficult to perform application with a uniform film thickness. In addition, this is because, when application is performed manually, it is difficult to perform working due to heat from the forging component. For this reason, even if the forging component is preheated, the temperature is preferably set to 200° C. or lower. More preferably, a lower limit of the preheating temperature of the forging component is 70° C., and most preferably 80° C. In addition, more preferably, an upper limit of the preheating temperature of the forging component is 150° C., and most preferably 120° C.

The thickness of the coating of the second glass lubricant applied to the surface of the forging component is not particularly limited as long as a lubricating ability is exhibited. However, the thickness is preferably 150 μm or more in order to prevent an increase in the forging load more reliably. On the other hand, when the second glass lubricant is excessively thickened, in the fourth process to be described below in which the forging component is heated, there is an increased risk of the second glass lubricant peeling off. In consideration of such a risk, the thickness is preferably 300 μm or less. Here, the thickness of the second glass lubricant can be measured by an eddy current film thickness meter.

In this case, it is preferable to ensure a coating thickness of 150 μm or more at a part in which lack of lubrication easily occurs during hot forging (for example, an end). In addition, it is preferable to ensure a coating thickness of 150 μm or more on average on the entire surface of the forging component. More preferably, a coating thickness on the entire surface of the forging component is 150 μm or more. When a coating thickness of the entire die face is measured, the thicknesses at a plurality of points including measurement points on at least the center and ends of the die face, and a midpoint thereof are evaluated.

<Fourth Process>

In the fourth process, the forging component 6 subjected to the third process is heated for hot forging. When the heating temperature of the forging component is adjusted according to a material of the second glass lubricant 7, the second glass lubricant 7 is softened and a viscosity at a temperature corresponding to the heating temperature of the forging component of $1\times10^2$ Pa·s or more is secured. In the fourth process, when a viscosity of the second glass lubricant is too low, there is a risk of the second glass lubricant peeling off from the forging component during heating. When the viscosity at the heating temperature of the forging component is set to $1\times10^2$ Pa·s or more, the second glass lubricant can be softened and can remain on the surface of the forging component. The viscosity is more preferably $1\times10^3$ Pa·s or more. Here, when it is described that a viscosity at a temperature "corresponding to" the heating temperature of the forging component is used, this means that, since it is difficult to actually measure a viscosity of the forging component during heating, a viscosity at the same temperature as the heating temperature of the forging component is evaluated in advance offline.

The heating temperature of the forging component may be set according to a material of the forging component. For example, a practical range is 850 to 1150° C. for a Ni-based heat-resistant superalloy and is 800 to 1100° C. for a Ti alloy. As described above, since the heating temperature of the lower die is set to be within the tempering temperature, the forging component is heated to a temperature higher than the heating temperature of the lower die in the second process. The forging component can be heated using, for example, a heating furnace.

<Fifth Process>

In the fifth process, the forging component 6 subjected to the fourth process is placed on the die face 3 of the lower die 1 subjected to the second process, and hot forging is performed using the lower die 1 and the upper die 2. A viscosity of the second glass lubricant at a temperature corresponding to the surface temperature of the forging component when hot forging starts in the fifth process is set to $1\times10^7$ Pa·s or less. The viscosity of the second glass lubricant is set to $1\times10^7$ Pa·s or less so that the second glass lubricant is softened and functions as a lubricant. The viscosity is more preferably $1\times10^6$ Pa·s or less and most preferably $1\times10^5$ Pa·s or less. Here, when it is described that a viscosity at a temperature "corresponding to" the surface temperature of the forging component when hot forging starts is used, this means that, since it is difficult to actually measure a viscosity of the forging component when hot forging starts, the surface temperature of the forging component when hot forging starts is evaluated or estimated in advance, and a viscosity at the same temperature as the surface temperature of the forging component when hot forging starts is evaluated offline. The forging component 6 taken out from the heating furnace through the fourth process is placed on the lower die 1 in the fifth process. However, the surface temperature of the forging component decreases before hot forging starts. The surface temperature of the heated forging component is typically in a range of 850° C. to 1000° C. for a Ni-based heat-resistant superalloy and in a range of 800° C. to 900° C. for a Ti alloy when hot forging starts. Accordingly, the viscosity at the temperature corresponding to the surface temperature of the forging component when hot forging starts is used as an indicator. In the case of a Ni-based heat-resistant superalloy, the viscosity of the second glass lubricant when hot forging starts can be simply evaluated typically as 850° C.

When the first glass lubricant, the second glass lubricant, and the like are selected as described above, while the first glass lubricant and the second glass lubricant are softened, it is possible to start hot forging in the fifth process. When hot forging starts, since the first glass lubricant and the second glass lubricant are softened, the effect of the lubricant is secured. In addition, when the softened first glass lubricant is present on the lower die, lack of lubrication during hot forging is prevented, which greatly contributes to reducing a forging load. It is possible to obtain the final form in which the pair of dies (the upper die and the lower die) are obtained in one pressing operation.

According to pressing in the vertical direction in the fifth process, the forging component is deformed in the lateral direction, and an end of the forging component slides on the die face 3. When the die face 3 of the lower die 1 is partially covered with the first glass lubricant as shown in FIG. 2A and FIG. 2B, the end of the forging component preferably slides on the die face 3 of the lower die 1 within an area in which the first glass lubricant has been applied. In such a configuration, since the lubricant is present at a part of the die face into which the forging component is newly brought due to the deformation, an effect of providing the first glass lubricant on the die face 3 of the lower die 1 is sufficiently exhibited. On the other hand, at a part with which the forging component is in contact when hot forging starts and the like, a lubrication effect according to the second glass lubricant provided on the forging component can be expected. When the die face of the lower die is partially covered with the first glass lubricant excluding such a part and the like, this contributes to reducing costs.

The above embodiment is particularly preferable for hot forging causing large deformation in which an end of the forging component is displaced by 200 mm or more on the die face 3 of the lower die 1. An amount of displacement in this case is an amount that an end (edge) part is displaced along the die face. For example, the amount of displacement is an amount of displacement of an end (edge) in the horizontal direction when the forging component has a vertically symmetric disk shape and corresponds to a size difference in diameter between before and after forging. An amount of displacement when the die face is inclined is an amount of displacement in a direction along the inclination.

Here, the surface temperature of the forging component when the hot forging process starts is slightly lower than the heating temperature in the fourth process. In this case, preferably, the surface temperature of the forging component when forging starts in the fifth process differs from the heating temperature in the fourth process by 50° C. or lower.

Since the above embodiment is particularly excellent in ensuring lubricity, this is particularly effective when forging is initially performed using a new die and when forging is performed using a die immediately after the surface has been repaired and cleaned. Another process can be included before, after and during the first to fifth processes. For example, a processing process can be performed after the fifth process. In addition, the order of the first and second processes and the third and fourth processes is not particularly limited, but they are preferably performed in parallel.

<First and Second Glass Lubricants>

The first and second glass lubricants will be described in more detail. As described above, one of important features is that materials of the first glass lubricant and the second glass lubricant are different from each other. The glass lubricant includes a glass composition, a medium, an additive, and the like. Different materials indicate different formulations of glass composition. As a type of the first glass lubricant, for example, a glass lubricant containing a phosphate glass as a main component can be used. On the other hand, as the second glass lubricant, for example, a glass lubricant containing a borosilicate glass as a main component can be used. Here, a resin binder may be additionally added to the first glass lubricant. When the resin binder is added, it is possible to prevent the first glass lubricant from peeling off from the die more reliably.

The first glass lubricant is softened at a lower temperature than the second glass lubricant, and the first glass lubricant has a lower viscosity than the second glass lubricant at the same temperature. This is to cope with a difference in heating temperature between the base material of the die and the forging component. If glass lubricants with the same material are used for covering the lower die 1 and the forging component, in the glass lubricant that is softened at a heating temperature of the lower die 1, the viscosity at the heating temperature of the forging component is too small, and the glass lubricant does not remain on the surface of the forging component. On the other hand, in the glass lubricant that is softened at a heating temperature of the forging component and remains on the surface of the forging component, a sufficiently softened state is not obtained at the heating temperature of the lower die, and a lubrication effect on the side of the die is not obtained. In order to address such problems, glass lubricants with different materials are used as the first and second glass lubricants. The viscosity of the glass lubricants can be measured using a spread meter method.

EXAMPLES

Figure 3:
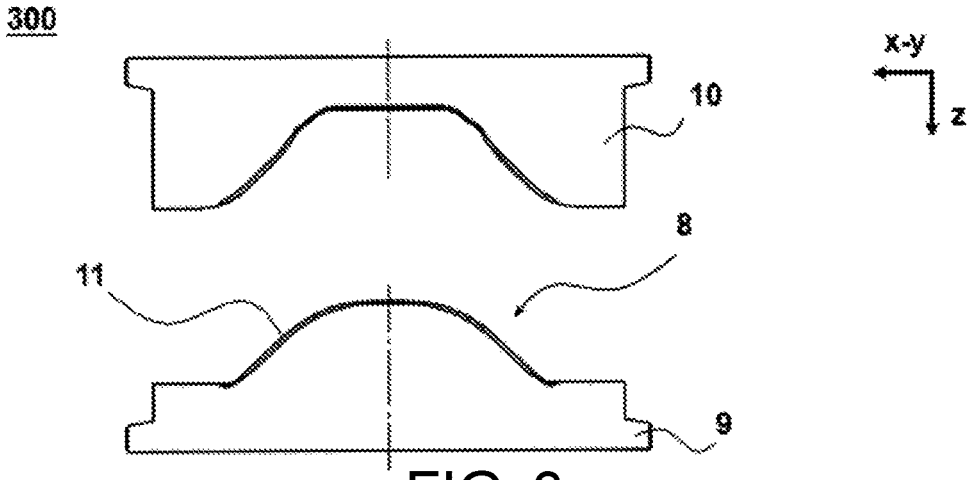
FIG. 3 is a schematic diagram showing another example of the die used in the embodiment according to the disclosure.

According to hot forging using a die 300 including a lower die 9 having an die face 8 and an upper die 10 disposed to face the lower die 9 shown in FIG. 3 as a general form, a hollow forged product having a substantially truncated cone shape was produced according to the following procedures. In both the lower die 9 and the upper die 10, a cladding layer 11 made of a Ni-based heat-resistant superalloy was formed on the die face 8.

Example

Figure 4:
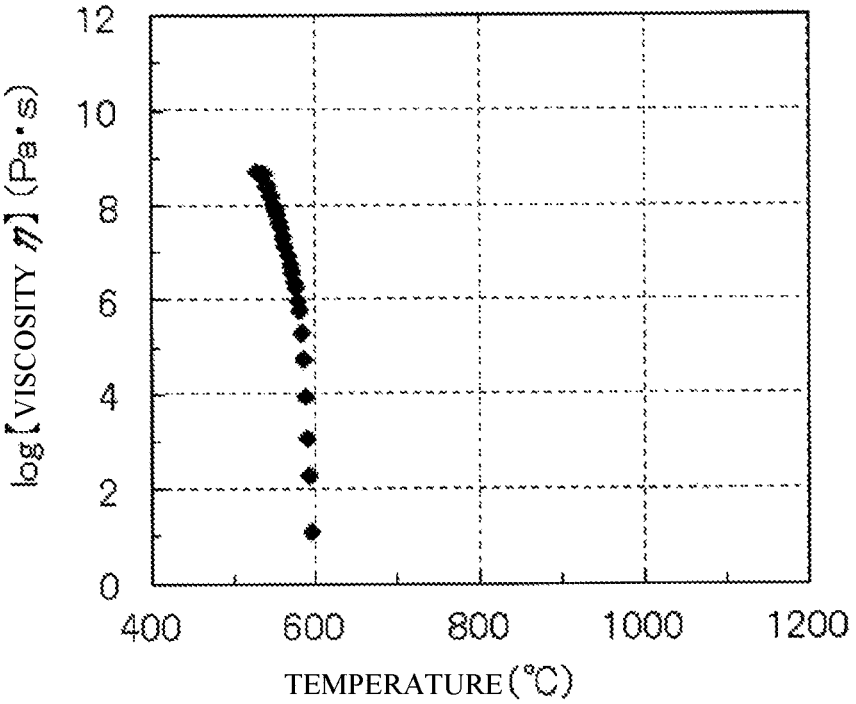
FIG. 4 is a diagram showing an example of dependence of a viscosity of a first glass lubricant on the temperature.

A disk-shaped forging component made of Alloy 718 (material) and with an outer diameter of 880 mm was used. The forging component was subjected to a sandblasting treatment. The outer circumference side of the die face of the lower die was covered with the first glass lubricant in an annular shape (first process). A phosphate glass lubricant was used as the first glass lubricant and coating was performed by spreading. FIG. 4 shows dependence of a viscosity of the glass lubricant used on the temperature. The viscosity was measured using a spread meter (PPVM-1100 commercially available from OPT Corporation). As shown in FIG. 4, the glass lubricant used softened at 520° C. or higher, the viscosity sharply decreased as the temperature increased, and the viscosity was $1\times10^9$ to 10 Pa·s in a range of 530 to 590° C. Specifically, the viscosity was $7\times10^7$ Pa·s at 550° C. and $2\times10^5$ Pa·s at 580° C. The first glass lubricant was applied in a range of 620 mm from a position of 270 mm from the center when viewed at a position in the horizontal direction so that it overlapped a part on the outer circumference side of the forging component when viewed in the vertical direction (the Z direction in FIG. 3) when the forging component was placed. The thickness of the first glass lubricant was measured at a position of 280 mm, a position of 440 mm, and a position of 610 mm, and the results were 99 μm, 107 μm, and 81 μm, respectively, and an average thereof was 96 μm.

Figure 5:
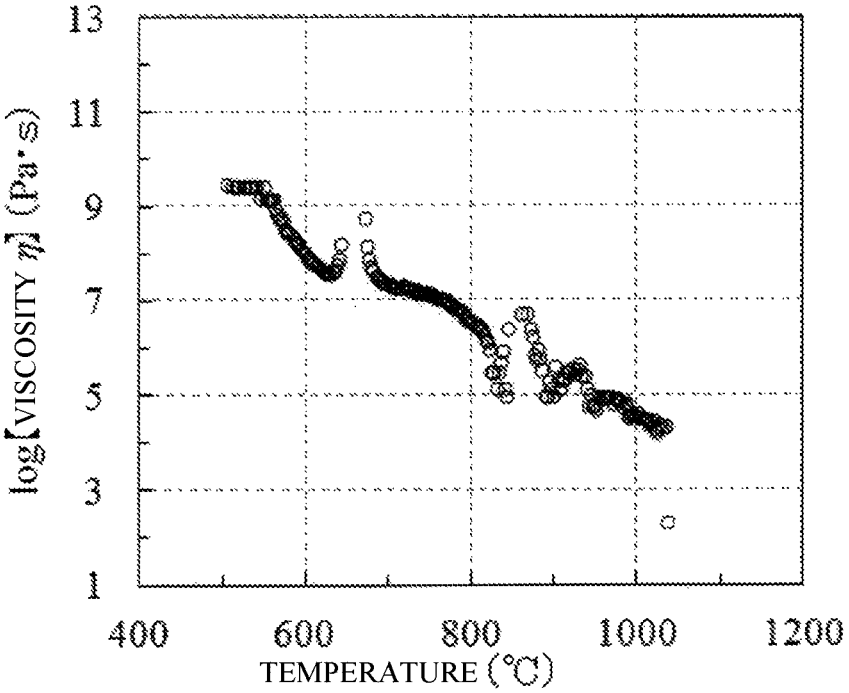
FIG. 5 is a diagram showing an example of dependence of a viscosity of a second glass lubricant on the temperature.

The lower die subjected to the first process was inserted into a heating furnace in the atmosphere together with the upper die and heated to 550° C. ($T_{wh}$) (second process). On the other hand, the entire surface of the forging component was covered with the second glass lubricant (third process). As borosilicate glass lubricant was used as the second glass lubricant and coating was performed by spraying. FIG. 5 shows dependence of a viscosity of the glass lubricant used on the temperature. As shown in FIG. 5, the glass lubricant used had a lower rate of decrease in viscosity with respect to the temperature than the first glass lubricant, and had a viscosity that gradually decreased as the temperature increased. The viscosity exceeded $1\times10^8$ Pa·s at 530° C., the viscosity was $1\times10^7$ Pa·s at 580° C., and $1\times10^7$ to $1\times10^4$ Pa·s in a range of 600 to 950° C., and a viscosity of greater than $1\times10^3$ Pa·s was maintained at 1000° C. The thickness of the second glass lubricant was measured at a position of 220 mm, a position of 310 mm, and a position of 390 mm from the center of the forging component, the results ware 260 μm, 280 μm, and 270 μm, respectively, and an average thereof was 270 μm. The forging component subjected to the third process was inserted into the heating furnace and heated to 1000° C. (fourth process). When heating was performed at 1000° C., the second glass lubricant was softened into a form of syrup and remained on the surface of the forging component. The upper die and the lower die heated in the second process were installed in the main body of the press machine, a dummy component heated to 1000° C. was then interposed between the lower die and the upper die, and the die was heated (die heating process). According to the die heating process, the temperature of the die face that had temporarily lowered increased to 530° C. The forging component subjected to the fourth process was placed on the die face of the lower die subjected to the second process and hot forging started while the first glass lubricant and the second glass lubricant were softened. Hot forging was performed at 500 MN using a hot forging machine, hot forging was performed using the lower die and the upper die in one pressing operation, and a forged product with an outer diameter of 1300 mm was obtained (fifth process). In this case, an end of the forging component slid on the die face of the lower die in an area in which the first glass lubricant has been applied, and was displaced by 350 mm on the die face of the lower die. Here, the temperature of the die face of the lower die and the surface temperature of the forging component when hot forging started were measured using a radiation thermometer. A heating temperature of the forging component and a viscosity of the second glass lubricant at a temperature corresponding to that temperature, a temperature of the forging component when hot forging started (when pressing started) and a viscosity of the second glass lubricant at a temperature corresponding to that temperature, a temperature regarded as the temperature $T_{ss}$ of the die face of the lower die when hot forging started (when pressing started) and a viscosity of the first glass lubricant at that temperature, and evaluation results of a maximum load in forging are shown in Table 1.

Comparative Example

A forged product was obtained in the same manner as in the above example except that the die face of the lower die was not covered with the first glass lubricant. Evaluation results such as a maximum load in forging and the like are shown in Table 1.

TABLE 1

| | Viscosity of second glass lubricant/heating temperature of forging component | Viscosity of second glass lubricant/temperature of forging component when hot forging starts | Viscosity of first glass lubricant/temperature of die face when hot forging starts | Maximum forging load |
|---|---|---|---|---|
| Example | $1 \times 10^3$ Pa · s/1000° C. | $1 \times 10^4$ Pa · s/960° C. | $2 \times 10^5$ Pa · s/580° C. | 390 MN |
| Comparative example | $1 \times 10^3$ Pa · s/1000° C. | $1 \times 10^4$ Pa · s/960° C. | — | 480 MN |

As shown in Table 1, in the method of producing a forged product according to the example, compared to the comparative example, a forging load was reduced by 15% or more, and forging with a load of less than 400 MN was possible. A forging machine with the highest pressuring capability was used, and moreover a load was reduced by 15% or more in a load range near a limit thereof, which indicates that the method is extremely effective in increasing a degree of freedom in producing a hard-to-process forged product. In addition, no scratches indicating lack of lubrication were found in the obtained forged product, and a surface condition of the forged product was extremely favorable.

What is claimed is:

1. A method of producing a forged product in which a forging component is hot-forged using a lower die and an upper die, the method comprising:

a first process in which a die face of the lower die is covered with a first glass lubricant;

a second process for softening the first glass lubricant in which the lower die subjected to the first process is heated;

a third process in which at least a part of the forging component is covered with a second glass lubricant;

a fourth process in which the forging component subjected to the third process is heated to a temperature that is higher than a heating temperature of the lower die in the second process for softening the second glass lubricant; and a fifth process in which the forging component subjected to the fourth process is placed on the die face of the lower die subjected to the second process and hot forging is performed using the lower die and the upper die, wherein materials of the first glass lubricant and the second glass lubricant are different from each other, wherein the second glass lubricant remains on a surface of the forging component that is softened in the fourth process, and wherein the hot forging in the fifth process starts while the first glass lubricant and the second glass lubricant are softened.

2. The method of producing a forged product according to claim 1, wherein the lower die and the upper die each have a Ni-based heat-resistant superalloy layer as a cladding layer on the die face.

3. The method of producing a forged product according to claim 1, wherein the second process further includes a die heating process performed after the lower die is heated, in which a preheated dummy component is interposed between the lower die and the upper die for additional heating of the die face of the lower die and a die face of the upper die.

4. The method of producing a forged product according to claim 1, wherein the die face of the lower die is partially covered with the first glass lubricant, and wherein, in the fifth process, an end of the forging component slides on the die face of the lower die in an area in which the first glass lubricant has been applied.

5. The method of producing a forged product according to claim 1, wherein the forging component is formed of a rotating body as a turbine disk for an aircraft jet engine.

6. The method of producing a forged product according to claim 1, wherein, in the fifth process, an end of the forging component is displaced by 200 mm or more on the die face of the lower die.

7. A method of producing a forged product in which a forging component is hot-forged using a lower die which has a die face and an upper die, the method comprising:

a first process in which the die face of the lower die is covered with a first glass lubricant;

a second process in which the lower die subjected to the first process is heated;

a third process in which at least a part of the forging component is covered with a second glass lubricant;

a fourth process in which the forging component subjected to the third process is heated to a temperature that is higher than a heating temperature of the lower die in the second process; and a fifth process in which the forging component subjected to the fourth process is placed on the die face of the lower die subjected to the second process and hot forging is performed using the lower die and the upper die, wherein materials of the first glass lubricant and the second glass lubricant are different froth each other, wherein a viscosity of the first glass lubricant at a temperature corresponding to a temperature of the die face of the lower die when the hot forging starts in the fifth process is $1\times10^7$ Pa·s or less, and wherein a viscosity of the second glass lubricant at a temperature corresponding to a heating temperature of the forging component in the fourth process is $1\times10^2$ Pa·s or more and the viscosity of the second glass lubricant at a temperature corresponding to a surface temperature of the forging component when the hot forging starts in the fifth process is $1\times10^7$ Pa·s or less.

8. The method of producing a forged product according to claim 7, wherein the lower die and the upper die each have a Ni-based heat-resistant superalloy layer as a cladding layer on the die face.

9. The method of producing a forged product according to claim 7, wherein the second process further includes a die heating process performed after the lower die is heated, in which a preheated dummy component is interposed between the lower die and the upper die for additional heating of the die face of the lower die and a die face of the upper die.

10. The method of producing a forged product according to claim 7, wherein the die face of the lower die is partially covered with the first glass lubricant, and wherein, in the fifth process, an end of the forging component slides on the die face of the lower die in an area in which the first glass lubricant has been applied.

11. The method of producing a forged product according to claim 7, wherein the forging component is formed of a rotating body as a turbine disk for an aircraft jet engine.

12. The method of producing a forged product according to claim 7, wherein, in the fifth process, an end of the forging component is displaced by 200 mm or more on the die face of the lower die.

* * * * *